US006514610B2

(12) United States Patent
Itoyama et al.

(10) Patent No.: US 6,514,610 B2
(45) Date of Patent: Feb. 4, 2003

(54) METHOD FOR MANUFACTURING IMPROVED REGENERATED CELLULOSE FIBER

(75) Inventors: Koki Itoyama, Shizuoka-ken; Masaki Mitsuhashi, Ito; Hiroaki Tanibe, Gotenba; Kikuo Kakizaki, Osaka, all of (JP)

(73) Assignee: Fuji Spinning Co., Ltd., Tokyo (JP)

( * ) Notice: Subject to any disclaimer, the term of this patent is extended or adjusted under 35 U.S.C. 154(b) by 0 days.

(21) Appl. No.: 09/730,784

(22) Filed: Dec. 7, 2000

(65) Prior Publication Data

US 2001/0004495 A1 Jun. 21, 2001

(30) Foreign Application Priority Data

Dec. 13, 1999 (JP) ..... 11-352668
Dec. 13, 1999 (JP) ..... 11-352669

(51) Int. Cl.[7] ..... D01F 6/00
(52) U.S. Cl. ..... 428/372; 428/393; 428/375
(58) Field of Search ..... 428/375, 393, 428/372; 536/20

(56) References Cited

U.S. PATENT DOCUMENTS 3,931,027 A * 1/1976 Sadler et al. ..... 252/63.7
4,689,159 A * 8/1987 Makashima ..... 252/8.6
4,966,699 A * 10/1990 Sasaki et al. ..... 210/321.8
4,982,793 A * 1/1991 Holtmyer et al. ..... 166/305.1
5,067,565 A * 11/1991 Holtmyer et al. ..... 166/305.1
5,122,529 A * 6/1992 Holotmyer et al. ..... 523/130
5,770,712 A * 6/1998 Roy et al. ..... 536/20
6,068,619 A * 5/2000 Hamajima et al. ..... 604/378

FOREIGN PATENT DOCUMENTS

| | | |
|---|---|---|
| JP | 5994681 | 5/1984 |
| JP | 9170126 | 6/1997 |
| JP | 10237765 | 9/1998 |
| JP | 1118771 | 7/1999 |

* cited by examiner

*Primary Examiner*—Newton Edwards
(74) *Attorney, Agent, or Firm*—Birch, Stewart, Kolasch & Birch, LLP

(57) ABSTRACT

A method for manufacturing improved regenerated cellulose fiber, by adding a crosslinking agent having two or more reactive functional groups in a molecule to a cellulose viscose solution and mixing, then extruding the viscose solution into a coagulation and regeneration bath, followed by applying a heat treatment, or followed by contacting obtained regenerated cellulose fiber with an aqueous solution of a crosslinking agent having two or more reactive functional groups in a molecule then applying a heat treatment.

8 Claims, No Drawings

METHOD FOR MANUFACTURING IMPROVED REGENERATED CELLULOSE FIBER

BACKGROUND OF THE INVENTION

1. Field of the Invention

The present invention relates to a method for manufacturing improved regenerated cellulose fiber with improved swelling in water and fibrillation character, which are intrinsic defects of regenerated cellulose fiber, together with superior handling. Improved regenerated cellulose fiber obtained by the present invention is utilized in wide application fields as yarn, woven and knitted fabrics, non-woven fabric and paper, exhibiting these performances.

2. Description of the Related Art

Regenerated cellulose fiber such as rayon and polynosic is composed of cellulose like natural fibers such as cotton and hemp, and has been an indispensable material in clothing field thanks to its superior moisture absorbing property and biodegradability. However, regenerated cellulose fiber, in particular rayon, has defects of poor stiffness and resilience, although superior in soft handling and draping. In addition, it has further defects such as poor water resistance leading to high degree of swelling in water and shrinkage percentage after washing and whitening due to fibrillation. Polynosic fiber have been developed to largely improve these properties of rayon and attained a certain level of improvement. However, the fiber is not sufficient in water resistance and stiffness compared with natural cellulose fibers such as cotton and hemp.

In order to eliminate these defects, treatments of regenerated cellulose fiber with a crosslinking agent have been tried since before. JP-A-59-94681, for example, discloses a method for crosslinking treatment of woven and knitted fabrics containing cellulose fiber with an epoxy crosslinking agent to obtain wash-and-wear and crease resistant characters. JP-B-10-237765 also discloses a method for improving handling by treating an artificial cellulose fiber or it's fabric with polyethylene glycol and an epoxy compound. However, in crossliking of regenerated cellulose fiber, treatment with a crosslinking agent after formation of cellulose fiber leads to a formation of crosslinks only in the vicinity of fiber surface because crosslinking agent hardly penetrate into an inner part of the fiber, and it results in an insufficient suppression of degree of swelling in water and a poor stiffness in physical properties, although fibrillation can be certainly suppressed.

JP-A-9-170126 discloses a method for a heat treatment of cellulose fiber yarn after contacting with formaldehyde vapor. This method enables a hydrophobic crosslinking agent of low molecular weight such as formaldehyde to penetrate into a fiber to form crosslinks in an inner part of a fiber, and thus to reduce fibrillation, suppress swelling and improve crease resistance. However, the method has defects such as reduction of moisture absorption which is an intrinsic superior performance of regenerated cellulose fiber, and lowering of strength. Use of increased amount of a crosslinking agent to improve degree of swelling and physical properties may attain improvement of degree of swelling, but is apt to cause defects such as stiffening of fiber, lowering of fiber strength and facilitated fibrillation.

As a method to promote a reaction of a crosslinking agent inside a fiber by performing the reaction during formation of a regenerated cellulose formed product, JP-A-11-187871, for example, discloses a method to drop a viscose solution into a coagulation bath then take out it and react with a crosslinking agent before completion of coagulation and regeneration. This method needs to take out a formed product in the way of coagulation in order to promote a reaction with a crosslinking agent inside a fiber. Thus, in an application to a fiber, it is difficult to apply to polynosic, although applicable to rayon with a skin-core structure. Furthermore, it is not practical to be applied to a continuous production process particularly for fiber, due to a difficulty in controlling a coagulation process.

BRIEF SUMMARY OF THE INVENTION

Object of the present invention is to provide a method for manufacturing improved regenerates cellulose fiber having reduced swelling in water, which is a defect of regenerated cellulose fiber, and superior handling, along with suppressed generation of fibrillation, by eliminating the defects described above.

Another object of the present invention is to provide an improved regenerated cellulose fiber and products obtained therefrom.

The inventor, after thorough studies to solve the defects described above, found out that fibrillation, swelling in water, shrinkage percentage after repeated washings and low stiffness, which were big defects of regenerated cellulose fiber, could be improved without reductions of strength and moisture absorption or deterioration in handling, by adding a crosslinking agent to a cellulose viscose solution then extruding the solution into a coagulation and regeneration bath, or by treating with a crosslinking agent solution again after spinning similarly as described above, and thus reached the present invention.

The present invention is a method for manufacturing improved regenerated cellulose fiber, by adding a crosslinking agent having two or more reactive functional groups in a molecule to a cellulose viscose solution and mixing, then extruding the viscose solution into a coagulation and regeneration bath, followed by applying a heat treatment. The present invention is also a method for manufacturing improved regenerated cellulose fiber, by adding a crosslinking agent having two or more reactive functional groups in a molecule to a cellulose viscose solution and mixing, then extruding the viscose solution into a coagulation and regeneration bath, followed by contacting thus obtained regenerated cellulose fiber with an aqueous solution of a crosslinking agent having two or more reactive functional groups in a molecule then applying a heat treatment. The present invention is further a method for manufacturing improved regenerated cellulose fiber, wherein the crosslinking agent used is an epoxy-based crosslinking agent, and still further a method for manufacturing improved regenerated cellulose fiber, wherein the amount of a crosslinking agent added to a cellulose viscose solution is 1–15% by weight to cellulose in a cellulose viscose solution. The present invention is furthermore a methods for manufacturing improved regenerated cellulose fiber, wherein the concentration of an aqueous solution of a crosslinking agent to be contacted with regenerated cellulose fiber after spinning is 1–10%.

Moreover, the present invention is a method for manufacturing improved regenerated cellulose fiber, wherein fine particles of mixed-in additives are added to a cellulose viscose solution and mixed in addition to a crosslinking agent, and furthermore is a method for manufacturing improved regenerated cellulose fiber, wherein the said mixed-in agent described above is fine granular chitosan.

Furthermore, the present invention is an improved regenerated cellulose fiber and products obtained therefrom.

DESCRIPTION OF THE PREFERRED EMBODIMENTS OF THE INVENTION

A crosslinking agent added to a cellulose viscose solution in the present invention is a compound having two or more reactive functional groups in a molecule, and preferably the reactive functional groups are glycidyl ether group or chlorohydrin group. Typical examples include those having two or more reactive functional groups in a molecule comprising ethyleneglycol types such as ethyleneglycol diglycidyl ether and polyethyleneglycol diglycidyl ether and propyleneglycol types such as propyleneglycol diglycidyl ether and polypropyleneglycol diglycidyl ether and the like. Epoxy-based crosslinking agents having three or more reactive functional groups such as glycerol glycidyl ether may also be used without any problem. Chlorohydrins before cyclization to epoxy compounds may also be used as a crosslinking agent of the present invention without any problem because these compounds are immediately cyclized to epoxy compounds due to an action of sodium hydroxide contained in a cellulose viscose solution in high concentration when added to a cellulose viscose solution. And the crosslinking agent used may be selected alone among the compounds described above or as a mixture of two or more thereof.

In a method for manufacturing improved regenerated cellulose fiber of the present invention, a spinning stock solution is prepared by adding a crosslinking agent described above to a cellulose viscose solution prepared in advance so that the concentration becomes 1–15% by weight to cellulose in the cellulose viscose solution, followed by mixing homogeneously. The concentration less than 1% by weight is not preferable due to little suppression effects on swelling in water, while the concentration higher than 15% by weight is not preferable due to lowering in physical properties of fiber such as strength.

Concerning a method for adding a crosslinking agent, a crosslinking agent, when it is water soluble, may be added simply to a cellulose viscose solution right before spinning or spinning may be performed after an agitation for a predetermined period after the addition. However, in using crosslinking agents of ethyleneglycol type with a high solubility in water, an attention should be paid to avoid leaking out of the agent into a coagulation and regeneration bath. In this case, the leaking out of the crosslinking agent into a coagulation and regeneration bath can be avoided, for example, by agitating for some period after the addition of the crosslinking agent to a viscose solution. Crosslinking agents of propyleneglycol type with a less solubility in water can be suitably used without leaking out into a coagulation and regeneration bath, even if they are added right before spinning. Moreover, crosslinking agents with a low or substantially little solubility in water may be added and mixed in an usual way, or preferably added as a dispersed solution to a cellulose viscose solution by dispersing with a dispersing agent such as surfactant in advance from the view point of a reactivity of the crosslinking agent. Furthermore, concerning a timing of addition in the case of hydrophobic crosslinking agents, they may be added to a cellulose viscose solution in advance or right before spinning.

In the present invention, in order to exhibit functions such as antibacterial activity, deodorizing property and dyeability, for example, fine particles of mixed-in additives such as fine granular regenerated chitosan, hollow fine particles and anionizing agent can be jointly used in addition to titanium dioxide as a dull agent usually used when the crosslinking agent described above is added.

Regenerated cellulose fiber is manufactured by spinning the spinning stock solution described above. Spinning conditions in this process are not specifically restricted, and the usual conditions to obtain regenerated cellulose fiber may be used.

Regenerated cellulose fiber obtained by spinning and scouring is then applied with a heat treatment to promote sufficienlty the reaction of a crosslinking agent contained in a fiber so that crosslinks are formed even at the central part of a fiber to obtain an improved regenerated cellulose fiber. Any condition of the heat treatment may be applicable so long as the reaction of a crosslinking agent is sufficiently performed, and typically, a condition, for example, at 130° C. for 15 min. is sufficient.

The process for manufacturing improved regenerated cellulose fiber of the present invention mentioned above can improve characteristics such as swelling in water and low stiffness, which are defects of regenerated cellulose fiber, without impairing superior properties intrinsic to regenerated cellulose fiber, due to a homogeneous formation of crosslinking between cellulose molecules by reacting a crosslynking agent contained in a fiber in an inner part of a fiber.

Furthermore, in the present invention, as described above, regenerated cellulose fiber obtained by adding a crosslinking agent to a cellulose viscose solution and mixing, is further applied with a crosslinking agent solution treatment and a heat treatment after a scouring process to suppress generation of fibrillation. The latter crosslinking agent may be an epoxy-based agent similar to the agent added to a viscose solution described above, and it may be the same to or different from that added to a stock solution. When a crosslinking agent has a low solubility in water, it may be dispersed using a dispersing agent such as surfactant. When chlorohydrin is used, a pretreatment for cyclization is necessary by adding an equivalent mole of sodium hydroxide. In this case, the concentration of crosslinking treatment is preferably performed with 1–10% aqueous solution of the crosslinking agent. The concentration of the crosslinking agent less than 1% is not preferable due to little effect on crosslinking to suppress fibrillation, while the concentration higher than 10% is not preferable due to an excessive crosslinking resulting in a hardened fiber surface and instead more easy fibrillation.

An improved regenerated cellulose fiber is obtained by applying a heat treatment followed by washing and drying, and the conditions of the heat treatment are desirably at 130° C. for 15 min. to perform the crosslinking treatment completely.

The process for manufacturing improved regenerated cellulose fiber of the present invention can improve characteristics such as fibrillation, swelling in water and low stiffness, which are defects of regenerated cellulose fiber, without impairing superior properties intrinsic to regenerated cellulose fiber, due to a homogeneous formation of crosslinking by reacting a crosslinking agent contained in a fiber in an inner part of a fiber, followed by promoting further crosslinking reaction at a fiber surface.

According to the present invention the improved regenerated cellulose fibers provide improvements in swelling in water, shrinkage percentage after washing and stiffness in handling, which are defects of regenerated cellulose fibers, without impairing a high moisture absorption or a flexibility both intrinsic to regenerated cellulose fibers, along with eliminating defects such as an easy generation of fibrillation. By these improvements, the present invention enables regenerated cellulose fibers to spread to various fields which have been unsuitable for regenerated cellulose fiber until now. The present invention also provides an enhancement in added value by adding fine particulates of mixed-in additives having functions such as antibacterial activity and deodorization together with the crosslinking agent to a spinning stock solution.

EXAMPLE

Hereinafter, the present invention will be explained in detail by Examples, however, it should be understood that the present invention is not restricted within this description range. The term of parts always means parts by weight and degree of swelling, shrinkage percentage after washing, strength, elongation, degree of fibrillation and handling (flexibility, stiffness) were measured according to the following methods.

Degree of Swelling

Degree of swelling was measured in accordance with JIS L 1015, "Testing Methods for Man-made Staple Fiber", 7.25 (Degree of Swelling in Water).

Shrinkage Percentage After Washing

Shrinkage percentage after 40 repeated washings was measured in accordance with JIS L 1042, "Testing Method for Shrinkage Percentage of Woven Fabric".

Strength and Elongation

Strength at break (cN/dtex) and elongation at break (%) were measured in accordance with JIS L 1015, "Testing Methods for Man-made Staple Fiber".

Degree of Fibrillation

Degree of fibrillation was judged based on a scanning electron microscopic observation of a sample after 40 repeated washings by the following criteria.

○: no fibril generation observed

Δ: a little fibril generations observed x: many fibril generations observed

Handling (flexibility, stiffness)

Handling of a knitted fabric prepared using an improved regenerated cellulose fiber yarn of the present invention was judged by a sensory test by ten inspectors. Each inspector scored 1 point for good handling and 0 point for poor handling, and the handling was judged by a total points based on the following criteria.

8–10 points: ○(Superior)

4–7 points: Δ(Good)

0–3 points: x (Poor)

Example 1

A polynosic viscose solution (cellulose 5.0%, total alkali 3.5% and total sulfur 3.0%) was prepared by an usual method, and polypropyleneglycol diglycidyl ether (Trade name; Denakol EX-931, a product of Nagase Chemicals Ltd.) was added to the solution so that the concentrations became 0.5, 1, 3, 5, 10, 15 and 20% by weight to cellulose in the said viscose solution respectively. Seven types of spinning stock solutions were thus prepared by agitating the solutions homogeneously. The spinning stock solutions were then spun through a nozzle of 0.07 mm×500 H at the spinning speed of 30 m/min in a spinning bath containing sulfuric acid 22 g/L, sodium sulfate 65 g/L and zinc sulfate 0.5 g/L at 35° C. The fibers obtained were then drawn by two times in a bath containing sulfuric acid 2 g/L and zinc sulfate 0.05 g/L at 25° C. followed by cutting to fiber length of 38 mm, and treated in a bath containing sodium carbonate 1 g/L and sodium sulfate 2 g/L at 60° C. and again in a bath of sulfuric acid 5 g/L at 65° C. After usual scouring, bleaching and washing with water, the fibers were applied with a heat treatment at 130° C. for 15 min., then washed with water again and dried. Seven types of improved regenerated cellulose fiber of polynosic, each being 1.39 dtex and about 5 kg, were prepared without fiber break and named as Sample No. 1–No. 7. In addition, a Comparative Sample No. 1 of conventional regenerated cellulose fiber of polynosic was prepared similarly as described above except for without adding the crosslinking agent.

Then, spun yarns (cotton yarn number 40) were prepared using each of the Samples No. 1–No. 7 from which plain stitch knitted fabrics were obtained respectively and named as Samples No. 3–No. 14. Also a knitted fabric was prepared similarly using the Comparative Sample No.1 and named as Comparative Sample No.2.

Table 1 shows data of strength, elongation and degree of swelling measured using the Samples No. 1–No. 7 and the Comparative Sample No. 1. Table 2 shows data of shrinkage percentage after washing and handling measured using the Samples No. 8–No. 14 and the Comparative Sample No.2.

TABLE 1

| | No. 1 | No. 2 | No. 3 | No. 4 | No. 5 | No. 6 | No. 7 | Comparative No. 1 |
|---|---|---|---|---|---|---|---|---|
| Addition Amount (%) | 0.5 | 1 | 3 | 5 | 10 | 15 | 20 | 0 |
| Strength (cN/dtex) | 3.89 | 3.76 | 3.58 | 3.51 | 3.50 | 3.73 | 3.22 | 3.81 |
| Elongation (%) | 9.7 | 9.6 | 9.6 | 9.4 | 9.2 | 9.3 | 8.5 | 9.7 |
| Degree of Swelling (%) | 68.0 | 66.5 | 65.3 | 64.2 | 60.0 | 59.2 | 58.0 | 68.1 |

TABLE 2

| | No. 8 | No. 9 | No. 10 | No. 11 | No. 12 | No. 13 | No. 14 | Comparative No. 2 |
|---|---|---|---|---|---|---|---|---|
| Addition Amount (%) | 0.5 | 1 | 3 | 5 | 10 | 15 | 20 | 0 |
| Shrinkage Percentage after Washing (%) | 10.3 | 5.5 | 4.3 | 1.0 | 0.5 | 0.5 | 0.4 | 11.3 |
| Handling (Flexibility) | ○ | ○ | ○ | ○ | ○ | ○ | Δ | ○ |
| Handling (Stiffness) | × | Δ | ○ | ○ | ○ | ○ | Δ | × |

As shown clearly in Tables 1 and 2, the Sample No. 1 with a lower addition amount of a crosslinking agent gives an equivalent degree of swelling to the Comparative Sample No. 1 of conventional polynosic fiber, and the Sample No. 8, the knitted fabric made using this yarn, does not show any improvement in shrinkage percentage after washing and handling compared with a knitted fabric of the Comparative Sample No. 2. On the contrary, the Sample No. 7 with an addition amount of a crosslinking agent of 20% gives remarkably lower strength and a poor spinning aptitude, proving not practical.

The Samples No. 2–No. 6 of the present invention with addition amounts of a crosslinking agent of 1–15% show improvements in degree of swelling nearly proportional to the amount of the crosslinking agent added. And the Samples No. 9–No. 13, the knitted fabrics using these yarns, give dramatically improved shrinkage percentages after washing and stiff handlings without losing flexibility characteristic to regenerated cellulose fiber.

Example 2

Ethyleneglycol diglycidyl ether (Trade name; Denakol EX-810, a product of Nagase Chemicals Ltd.), propyleneglycol diglycidyl ether (Trade name; Denakol EX-911, a product of Nagase Chemicals Ltd.), polypropyleneglycol diglycidyl ether (Trade name; Denakol EX-931, a product of Nagase Chemicals Ltd.), glycerol polyglycidyl ether (Trade name; Denakol EX-314, a product of Nagase Chemicals Ltd.) and hexamethylene bis-(3-chloro-2-hydroxypropyldimethylammonium chloride) (Trade name; Cationon-UK, a product of Ipposha Oil Industry Co., Ltd.) were added separately to the polynosic viscose solutions prepared similarly as in Example 1 so that the concentration being 5% by weight to cellulose in the solution. Five types of spinning stock solutions were thus prepared by agitating for 1 hour. Fibers obtained by spinning these stock solutions under the similar conditions as in Example 1 were scoured, bleached and washed with water as usual, followed by heat treatment at 130° C. for 15 min., washing with water again and drying. Five types of improved regenerated cellulose fiber of polynosic, each being 1.39 dtex and about 5 kg, were prepared without fiber break and named as Samples No. 15–No. 19.

Subsequently, knitted fabrics of Samples No. 20–No. 24 were prepared similarly as in Example 1 using each of Samples No. 15–No. 19.

Table 3 shows data of strength, elongation and degree of swelling measured using the Samples No. 15–No. 19. Table 4 shows data of shrinkage percentage after washing and handling measured using the Samples No. 20–No. 24.

TABLE 3

| | No. 15 | No. 16 | No. 17 | No. 18 | No. 19 |
|---|---|---|---|---|---|
| Addition Amount (%) | 5 | 5 | 5 | 5 | 5 |
| Strength (cN/dtex) | 3.89 | 3.76 | 3.51 | 3.58 | 3.50 |
| Elongation (%) | 9.7 | 9.6 | 9.4 | 9.4 | 9.2 |
| Degree of Swelling (%) | 63.8 | 64.0 | 64.2 | 63.5 | 64.5 |

TABLE 4

| | No. 20 | No. 21 | No. 22 | No. 23 | No. 23 |
|---|---|---|---|---|---|
| Addition Amount (%) | 5 | 5 | 5 | 5 | 5 |
| Shrinkage Percentage after Washing (%) | 2.0 | 3.2 | 1.0 | 1.2 | 1.9 |
| Handling (Flexibility) | ○ | ○ | ○ | ○ | ○ |

TABLE 4-continued

| | No. 20 | No. 21 | No. 22 | No. 23 | No. 23 |
|---|---|---|---|---|---|
| Handling (Stiffness) | ○ | ○ | ○ | ○ | Δ |

As shown clearly in Tables 3 and 4, even with the crosslinking agents different from that in Example 1, the method of the present invention improves degree of swelling without losing strength and elongation, also gives a remarkably improved shrinkage percentage after washing and a stiff handling without losing an intrinsic flexibility in the knitted fabric Samples made from these yarns.

Example 3

A rayon viscose solution (cellulose 9.0%, total alkali 6.0% and total sulfur 2.5%) was prepared by an usual method, and polypropyleneglycol diglycidyl ether (Trade name; Denakol EX-931, a product of Nagase Chemicals Ltd.) was added to the solution so that the concentrations became 0.5, 1, 3, 5, 10, 15 and 20% by weight. The solutions were mixed homogeneously to give seven types of spinning stock solutions. The spinning stock solutions thus 5 obtained were then spun through a nozzle of 0.09 mm×100 H at the spinning speed of 55 m/min in a spinning bath containing sulfuric acid 110 g/L, sodium sulfate 30 g/L and zinc sulfate 15g/L at 50° C. The fibers obtained were then drawn by an usual two bath tension spinning method, followed by cutting to fiber length of 38 mm, and usual scouring, bleaching and washing with water, then by a heat treatment at 130° C. for 15 min., washing with water again and drying. Seven improved regenerated cellulose fiber of rayon, each being about 3.33 dtex and about 5 kg, thus prepared without fiber break were named as Samples No. 25–No. 31. Also a Comparative Sample No. 3 of a conventional regenerated cellulose fiber of rayon was prepared similarly except for without adding a crosslinking agent.

Spun yarns (cotton yarn number 40) were then prepared using each of the Sample No. 25–No. 31 from which plain stitch knitted fabrics named as Samples No. 32–No. 38 were obtained respectively. Also a knitted fabric was prepared similarly using the Comparative Sample No. 3 and named as Comparative Sample No. 4.

Table 5 shows data of strength, elongation and degree of swelling measured using the Samples No. 25–No. 31 and the Comparative Sample No. 3. Table 6 shows data of shrinkage percentage after washing and handling measured using the Samples No. 32–No. 38 and the Comparative Sample No. 4.

TABLE 5

| | No. 25 | No. 26 | No. 27 | No. 28 | No. 29 | No. 30 | No. 31 | Comparative No. 3 |
|---|---|---|---|---|---|---|---|---|
| Addition Amount (%) | 0.5 | 1 | 3 | 5 | 10 | 15 | 20 | 0 |
| Strength (cN/dtex) | 2.45 | 2.46 | 2.55 | 2.50 | 2.46 | 2.53 | 2.20 | 2.42 |
| Elongation (%) | 17.8 | 17.5 | 16.5 | 16.0 | 16.2 | 16.3 | 16.3 | 18.0 |
| Degree of Swelling (%) | 88.2 | 85.3 | 82.3 | 80.3 | 80.2 | 79.6 | 78.0 | 90.4 |

TABLE 6

| | No. 32 | No. 33 | No. 34 | No. 35 | No. 36 | No. 37 | No. 38 | Comparative No. 4 |
|---|---|---|---|---|---|---|---|---|
| Addition Amount (%) | 0.5 | 1 | 3 | 5 | 10 | 15 | 20 | 0 |
| Shrinkage Percentage after Washing (%) | 14.3 | 10.5 | 5.3 | 4.2 | 4.0 | 4.0 | 3.5 | 15.0 |
| Handling (Flexibility) | ○ | ○ | ○ | ○ | ○ | ○ | Δ | ○ |
| Handling (Stiffness) | × | Δ | ○ | ○ | ○ | ○ | ○ | × |

As shown clearly in Tables 5 and 6, the Sample No. 25 with a lower addition amount of a crosslinking agent gives an equivalent degree of swelling to the Comparative Sample No. 3 of a conventional rayon fiber, and the Sample No. 32, a knitted fabric made using this yarn, does not show any improvement in shrinkage percentage after washing and handling compared with the Comparative Sample No. 4. On the contrary, the Sample No. 31 with an addition amount of a crosslinking agent of 20% gives a remarkably lower strength and a poor spinning aptitude, proving not practical.

The Samples No. 26–No. 30 of the present invention with the addition amounts of a crosslinking agent of 1–15% show improved degree of swelling nearly proportional to the amount of the crosslinking agent added and a tendency of increasing strength to some degree due to formation of the crosslinkings. Likewise, the Samples No. 33–No.37, knitted fabrics using these yarns, also give remarkable improvements in shrinkage percentage after washing and stiff handlings without losing a flexibility characteristic to regenerated cellulose fiber.

Example 4

Chitosan with degree of deacetylation of 82% and an average molecular weight of 42,000 was dissolved in an aqueous solution of acetic acid, then coagulated and regenerated to granules in an alkaline solution. After washed with water sufficiently, the granules were pulverized and spray-dried in an atmosphere at 180° C. to give fine granular regenerated chitosan with a particle diameter not larger than 10 $\mu$m. The fine granular regenerated chitosan thus prepared was added to a polynosic viscose solution prepared similarly as in Example 1 so that the concentration of chitosan to cellulose in the viscose solution became 1% by weight. Subsequently, polypropyleneglycol diglycidyl ether (Trade name; Denakol EX-931, a product of Nagase Chemicals Ltd.) was added so that the concentration became 5% by weight to cellulose in the viscose solution. A spinning stock solution was prepared by agitating the solution for 1 hr. The fiber obtained by spinning. This stock solution under the similar conditions as in Example 1 was scoured, bleached and washed with water as usual, followed by a heat treatment at 130° C. for 15 min., washing with water again and drying. An improved regenerated cellulose fiber of polynosic of 5 kg and about 1.39 dtex was thus prepared without fiber break and named Sample No. 39. A knitted fabric of Sample No. 40 was then prepared likewise as in Example 1 using this fiber.

Table 8 shows data of strength, elongation and degree of swelling measured using the Sample No. 39. Table 8 shows data of shrinkage percentage after washing and handling measured using the Sample No. 40.

TABLE 7

| | No. 39 | Comparative No. 1 |
|---|---|---|
| Addition Amount (%) | 5 | 0 |
| Strength (cN/dtex) | 3.50 | 3.81 |
| Elongation (%) | 9.8 | 9.7 |
| Degree of Swelling (%) | 65.2 | 68.1 |

TABLE 8

| | No. 40 | Comparative No. 2 |
|---|---|---|
| Addition Amount (%) | 5 | 0 |
| Shrinkage Percentage after Washing (%) | 1.3 | 11.3 |
| Handling (Flexibility) | ○ | ○ |
| Handling (Stiffness) | ○ | × |

As shown clearly in Tables 7 and 8, an addition of the fine granular chitosan, a different type of additive, to a cellulose viscose solution in preparing an improved regenerated cellulose fiber in accordance with the present invention also improves degree of swelling without impairing strength and elongation. The knitted fabric of the Sample No. 40 made using this yarn provides a dramatic improvement in shrinkage percentage after washing and a stiff handling without losing an intrinsic flexibility. A sufficient antibacterial activity was observed with the knitted fabric of the Sample No. 40 in an evaluation on an antibacterial activity in accordance with JIS L 1902 (1998).

Example 5

Fibers obtained by spinning under the same conditions as in Example 1 were scoured, bleached and washed by an usual method were treated with an aqueous solution of 5% by weight of ethyleneglycol diglycidyl ether (Trade name; Denakol EX-810, a product of Nagase Chemicals Ltd.). The fibers were applied with a heat treatment at 130° C. for 15 min., then washed with water and dried. Improved regenerated cellulose fiber of polynosic, each being about 1.39 dtex and about 5 kg, were thus prepared without fiber break and named as Samples No. 41–No. 47. A regenerated cellulose fiber of polynosic was also prepared without addition of the crosslinking agent but similarly applied with a crosslinking treatment after spinning and named as Comparative Sample No. 5. In addition, a conventional regenerated cellulose fiber of polynosic obtained similarly as described above without the addition of the crosslinking agents was named as Comparative Sample No. 6.

Spun yarns (cotton yarn number 40) were then prepared using each of the Samples No. 41–No. 47 from which plain stitch knitted fabrics were obtained and named as Samples No. 48–No. 54. In addition, plain stitch knitted fabrics were also prepared using the Comparative Samples No. 5 and No. 6 and named as Comparative Samples No. 7 and No. 8 respectively.

Table 9 shows data of strength, elongation and degree of swelling measured using the Samples No. 41–No. 47 and the Comparative Samples No. 5 and No. 6. Table 10 shows data of shrinkage percentage after washing, handling and degree of fibrillation measured using the Samples No. 48–No. 54 and the Comparative Samples No. 7 and No. 8.

TABLE 9

| | No. 41 | No. 42 | No. 43 | No. 44 | No. 45 | No. 46 | No. 47 | Comparative No. 5 | Comparative No. 6 |
|---|---|---|---|---|---|---|---|---|---|
| Strength (cN/dtex) | 3.91 | 3.80 | 3.60 | 3.55 | 3.43 | 3.70 | 3.25 | 3.85 | 3.92 |
| Elongation (%) | 9.8 | 9.5 | 9.5 | 9.3 | 9.0 | 9.2 | 9.0 | 9.7 | 9.8 |
| Degree of Swelling (%) | 67.8 | 66.3 | 65.0 | 63.8 | 60.2 | 58.9 | 57.8 | 68.1 | 70.0 |

TABLE 10

| | No. 48 | No. 49 | No. 50 | No. 51 | No. 52 | No. 53 | No. 54 | Comparative No. 7 | Comparative No. 8 |
|---|---|---|---|---|---|---|---|---|---|
| Shrinkage Percentage after Washing (%) | 10.1 | 5.3 | 4.2 | 1.0 | 0.6 | 0.5 | 0.5 | 8.5 | 10.3 |
| Handling (Flexibility) | ○ | ○ | ○ | ○ | ○ | ○ | ○ | Δ | ○ |
| Handling (Stiffness) | × | ○ | ○ | ○ | ○ | ○ | ○ | × | × |
| Degree of Fibrilation | Δ | ○ | ○ | ○ | ○ | ○ | ○ | ○ | × |

As shown clearly in Tables 9 and 10, Sample No. 41 with the lower addition amount of a crosslinking agent to a cellulose viscose solution gives an equivalent degree of swelling to the Comparative Sample No. 6 of the conventional polynosic, and the Sample No. 48, a plain stitch knitted fabric made using this yam, does not give a stiff handling nor a suppressed fibrillation. On the contrary, the Sample No. 47 with the addition amount of a crosslinking agent of 20% gives a remarkably lower strength and a poor spinning aptitude, proving not practical. The Comparative Sample No. 5 without the addition of the crosslinking agent in spinning and crosslinked only after spinning shows little suppression effect on degree of swelling, and the Comparative Sample No. 7, the plain stitch knitted fabric using this yarn, loses a flexibility and a stiff handling, although showed a suppressed fibrillation.

On the other hand, the Samples No. 42–No. 46, with the addition amounts of a crosslinking agent of 1–15%, show suppressions of degree of swelling nearly proportional to the amount of the crosslinking agent added and lowering of strength within a practiceally acceptable level. The Samples No. 49–No. 53, plain stitch knitted fabrics using these yarns, give remarkable improvements in shrinkage percentage after washing, and exhibit stiff handlings and sufficiently suppressed fibrillation.

EXAMPLE 6

A rayon viscose solution (cellulose 9.0%, total alkali 6.0% and total sulfur 2.5%) was prepared by an usual method, and polypropyleneglycol diglycidyl ether (Trade name; Denakol EX-931, a product of Nagase Chemicals Ltd.) was added separately to the rayon viscose solution so that the concentrations became 0.5, 1, 3, 5, 10, 15 and 20% by weight to cellulose in the solution respectively and agitated homogeneously to give seven types of spinning stock solutions. The spinning stock solutions thus obtained were then spun through a nozzle of 0.09 mm×100 H at the spinning speed of 55 m/min in a spinning bath containing sulfuric acid 110 g/L, sodium sulfate 30 g/L and zinc sulfate 15g/L at 50° C. The fibers obtained were then drawn by an usual two bath tension spinning method, followed by cutting to fiber length of 38 mm, then usual scouring, bleaching and washing with water, and after treatment with an aqueous solution of 5% by weight of ethyleneglycol diglycidyl ether (Trade name; Denakol Ex-810, a product of Nagase Chemicals Ltd.). Subsequently the fibers were applied with a heat treatment at 130° C. for 15 min., then washed with water and dried. Seven improved regenerated cellulose fiber of rayon, each being about 3.33 dtex and about 5 kg, thus prepared were named as Samples No. 55–No. 61. In addition, a regenerated cellulose fiber of rayon was prepared by spinning similarly as described above without the addition of the crosslinking agent but by crosslinking after spinning similarly as described above, and named as Comparative Sample No. 9. Furthermore, a conventional regenerated cellulose fiber of rayon was also prepared similarly as described above without using a crosslinking agent, and was named as Comparative Sample No. 10.

Spun yarns (cotton yarn number 40) were then prepared using each of the Sample No. 55–No. 61 from which plain stitch knitted fabrics were prepared and named as Samples No. 62–No. 68. In addition, knitted fabrics were also prepared using the Comparative Samples No. 9 and No. 10 and named as Comparative Samples No. 11 and No. 12.

Table 11 shows data of strength, elongation and degree of swelling measured using the Samples No. 55–No. 61 and the Comparative Sample No. 10. Table 12 shows data of shrinkage percentage after washing, handling and degree of fibrillation measured using the Samples No. 62–No. 68 and the Comparative Samples No. 11 and No. 12.

TABLE 11

| | No. 55 | No. 56 | No. 57 | No. 58 | No. 59 | No. 60 | No. 61 | Comparative No.9 | Comparative No.10 |
|---|---|---|---|---|---|---|---|---|---|
| Strength (cN/dtex) | 2.46 | 2.48 | 2.56 | 2.60 | 2.54 | 2.50 | 2.10 | 2.38 | 2.42 |
| Elongation (%) | 17.6 | 17.4 | 16.3 | 15.8 | 16.0 | 16.1 | 16.1 | 17.6 | 18.0 |
| Degree of Swelling (%) | 88.1 | 84.8 | 81.3 | 80.0 | 79.8 | 76.0 | 74.3 | 89.8 | 90.5 |

TABLE 12

| | No. 62 | No. 63 | No. 64 | No. 65 | No. 66 | No. 67 | No. 58 | Comparative No. 11 | Comparative No. 12 |
|---|---|---|---|---|---|---|---|---|---|
| Shrinkage Percentage after Washing (%) | 14.1 | 9.9 | 5.0 | 3.2 | 3.3 | 3.0 | 2.5 | 12.3 | 15.0 |
| Handling (Flexibility) | ○ | ○ | ○ | ○ | ○ | ○ | ○ | Δ | ○ |
| Handling (Stiffness) | × | Δ | ○ | ○ | ○ | ○ | ○ | × | × |
| Degree of Fibrilation | ○ | ○ | ○ | ○ | ○ | ○ | ○ | ○ | × |

As shown clearly in Tables 11 and 12, even regenerated cellulose fiber of rayon different from the regenerated cellulose fiber of polynosic in the Example 5 exhibit similar superior effects.

More concretely, the Sample No. 55 with lower addition amount of a crosslinking agent to the viscose solution gives an equivalent degree of swelling to the Comparative Sample No. 10 of the conventional rayon, and the Sample No. 62 of the plain stitch knitted fabric made using this yarn does not show a stiff handling. On the contrary, the Sample No. 61 with the addition amount of a crosslinking agent of 20% gives a remarkably lower strength and a poor spinning aptitude, proving not practical. The Comparative Sample No. 9, without the addition of a crosslinking agent in spinning process but crosslinked only after spinning, shows little effect on suppression of degree of swelling and the Comparative Sample No. 11, the plain stitch knitted fabric using this yarn, loses flexibility and stiff handling, although fibrillation is suppressed.

The Samples No. 56–No. 60 with the amount of a crosslinking agent of 1–15% added to the viscose solution show suppression of degree of swelling nearly proportional to the amount of the crosslinking agent added and lowering of strength is within a practically acceptable level. The Samples No. 63–No. 67, the plain stitch knitted fabrics using these yarns, give remarkable improvements in shrinkage percentage after washing and stiff handlings along with sufficiently suppressed generation of fibrillation.

EXAMPLE 7

A polynosic viscose solution (cellulose 5.0%, total alkali 3.5% and total sulfur 3.0%) was prepared by an usual method, and polypropyleneglycol diglycidyl ether (Trade name; Denakol EX-931, a product of Nagase Chemicals Ltd.) was added to the solution so that the concentration became 5% by weight to cellulose in the viscose solution, followed by mixing the solution homogeneously. Spinning was performed under the similar conditions as in Example 6 and washed with water And continuously, the fibers obtained were separately treated with aqueous solutions of 0.5, 1, 3, 5, 10 and 15 % by weight of ethyleneglycol diglycidyl ether (Trade name; Denakol EX-810, a product of Nagase Chemicals Ltd.) . Subsequently the fibers were applied with a heat treatment at 130° C. for 15 min., then washed with water and dried again to give six types of improved regenerated cellulose fiber, each being 1.39 dtex and about 5 kg, and named as Sample No. 69–No. 74. In addition, a Comparative Sample No. 13 of regenerated cellulose fiber was prepared similarly without a crosslinking treatment after spinning.

Spun yarns (cotton yarn number 40) were then prepared using each of the Sample No. 69–No. 74 from which plain stitch knitted fabrics were prepared and named as Samples No. 75–No. 80. Furthermore a plain stitch knitted fabric was also prepared using the Comparative Sample No. 13 and named as Comparative Sample No. 14.

Table 13 shows data of strength, elongation and degree of swelling measured using the Samples No. 69–No. 74 and the Comparative Sample No. 13. Table 14 shows data of shrinkage percentage after washing, handling and degree of fibrillation measured using the Samples No. 75–No. 80 and the Comparative Sample No. 14.

TABLE 13

| | No. 69 | No. 70 | No. 71 | No. 72 | No. 73 | No. 74 | Comparative No. 13 |
|---|---|---|---|---|---|---|---|
| Strength (cN/dtex) | 3.55 | 3.60 | 3.65 | 3.55 | 3.43 | 3.40 | 3.58 |
| Elongation (%) | 9.7 | 9.5 | 9.4 | 9.3 | 9.0 | 9.2 | 9.5 |
| Degree of Swelling (%) | 64.0 | 63.9 | 63.8 | 63.8 | 63.5 | 63.0 | 63.9 |

TABLE 14

| | No. 75 | No. 76 | No. 77 | No. 78 | No. 79 | No. 80 | Comparative No. 14 |
|---|---|---|---|---|---|---|---|
| Shrinkage Percentage after Washing (%) | 2.0 | 2.0 | 1.5 | 1.0 | 1.0 | 0.8 | 1.2 |
| Handling (Flexibility) | ○ | ○ | ○ | ○ | ○ | Δ | ○ |
| Handling (Stiffness) | ○ | ○ | ○ | ○ | ○ | ○ | ○ |
| Degree of Fibrilation | × | ○ | ○ | ○ | ○ | × | × |

As shown clearly in Tables 13 and 14, all samples are superior in both of suppression of swelling and strength due to the spinning with an addition of a crosslinking agent in a viscose solution. However, the Comparative Sample No. 14 and the Sample No. 75, which are plain stitch knitted fabrics made using the Comparative Sample No. 13 prepared without crosslinking treatment after spinning and the Sample No. 69 prepared with a lower concentration of the crosslinking agent after spinning respectively, show remarkable fibrillations. In addition, a plain stitch knitted fabric of the Sample No. 80 prepared by using the Sample No. 74 with a high concentration of a crosslinking agent in the crosslinking treatment after spinning also causes fibrillation by hardening of a fiber itself due to excessive crosslinking at fiber surface.

On the other hand, plain stitch knitted fabrics of the Samples No. 76–No. 79 prepared using the Samples No. 70–No. 73 of the present invention suppress the fibrillation and give stiff handlings.

EXAMPLE 8

A polynosic viscose solution (cellulose 5.0%, total alkali 3.5% and total sulfur 3.0%) was prepared by an usual method, and ethyleneglycol diglycidyl ether (Trade name; Denakol EX- 810, a product of Nagase Chemicals Ltd.), propyleneglycol diglycidyl ether (Trade name; Denakol EX-911, a product of Nagase Chemicals Ltd.), polypropyleneglycol diglycidyl ether (Trade name; Denakol EX-931, a product of Nagase Chemicals Ltd.), glycerol polyglycidyl ether (Trade name; Denakol EX-314, a product of Nagase Chemicals Ltd.) and hexamethylene bis-(3-chloro-2-hydroxypropyldimethylammonium chloride) (Trade name; Cationon- UK, a product of Ipposha Oil Industry Co., Ltd.) were added separately to the solution so that each concentration became 5% by weight to cellulose in the viscose solution and agitated the solution for 1 hour. Spinning was performed under the similar spinning conditions as in Example 5 to give five types of regenerated cellulose fiber. After usual bleaching and washing with water, each fiber was treated with an aqueous solution of 5% by weight of ethyleneglycol diglycidyl ether (Trade name; Denakol EX-810, a product of Nagase Chemicals Ltd.). Subsequently, the fibers were applied with a heat treatment at 130° C. for 15 min., washed with water and then dried again, and five types of improved regenerated cellulose fiber of polynosic were obtained and named as Samples No. 81–No. 85. Spun yarns (cotton yarn number 40) were then prepared using these yarns from which plain stitch knitted fabrics were prepared and named as Samples No. 86–No. 90.

Table 15 shows data of strength, elongation and degree of swelling measured using the Samples No. 81–No. 85. Table 16 shows data of shrinkage percentage after washing, handling and degree of fibrillation measured using the Samples No. 86–No. 90.

TABLE 15

| | No. 81 | No. 82 | No. 83 | No. 84 | No. 85 |
|---|---|---|---|---|---|
| Strength (cN/dtex) | 3.89 | 3.77 | 3.55 | 3.58 | 3.52 |
| Elongation (%) | 9.7 | 9.6 | 9.3 | 9.4 | 9.2 |
| Degree of Swelling (%) | 63.5 | 63.8 | 63.8 | 64.5 | 64.2 |

TABLE 16

| | No. 86 | No. 87 | No. 88 | No. 89 | No. 90 |
|---|---|---|---|---|---|
| Shrinkage Percentage after Washing (%) | 2.0 | 3.0 | 1.0 | 1.2 | 3.0 |
| Handling (Flexibility) | ○ | ○ | ○ | ○ | ○ |
| Handling (Stiffness) | ○ | ○ | ○ | ○ | ○ |
| Degree of Fibrilation | ○ | ○ | ○ | ○ | ○ |

As shown clearly in Tables 15 and 16, even if other types of crosslinking agents are added to a cellulose viscose solution, so long as they are epoxy-based crosslinking agents, they also provides a superior suppression of degree of swelling without impairing fiber physical properties such as strength, along with a dramatic improvement in shrinkage percentage after washing and a suppressed fibrillation, in addition to a stiff handling in knitted fabric. The Samples No. 85 and No. 90 using chlorohydrin as a crosslinking agent provide quite similar effects because chlorohydrin cyclizes by alkali in the viscose solution and reacts as an epoxy compound.

EXAMPLE 9

Chitosan with degree of deacetylation of 82% and an average molecular weight of 42,000 was dissolved in an aqueous solution of acetic acid, followed by coagulation and regeneration to granules in an alkaline solution. After washing sufficiently, the granules were pulverized and spray-dried in an atmosphere at 180° C. to give fine granular regenerated chitosan with a particle diameter not larger than 10 $\mu$m. The fine granular regenerated chitosan thus prepared was added to a polynosic viscose solution prepared similarly as in Example 5 so that the concentration of chitosan to cellulose in the viscose solution became 1% by weight, and polypropyleneglycol diglycidyl ether (Trade name; Denakol EX-931, a product of Nagase Chemicals Ltd.) was also added to the solution so that the concentration became 5% by weight to cellulose in the viscose solution, followed by agitation for 1 hour to give a spinning stock solution. Fiber obtained by spinning under the similar conditions as in Example 1 was scoured, bleached and washed as usual, followed by treatment with an aqueous solution of 5% by weight of ethyleneglycol diglycidyl ether (Trade name; Denakol EX-810, a product of Nagase Chemicals Ltd.). Subsequently, the fiber was applied with a heat treatment at 130° C. for 15 min., washed with water again and dried. An improved regenerated cellulose fiber of polynosic of about 1.39 dtex and 5 kg was thus prepared without fiber break and named as Sample No. 91. A plain stitch knitted fabric of Sample No. 92 was prepared similarly as in Example 5 using this yarn.

Table 17 shows data of strength, elongation and degree of swelling measured using the Sample No. 91. Table 18 shows data of shrinkage percentage after washing, handling and degree of fibrillation measured using the Sample No. 92.

TABLE 17

| | No. 91 |
|---|---|
| Strength (cN/dtex) | 3.48 |
| Elongation (%) | 10.2 |
| Degree of Swelling (%) | 66.0 |

TABLE 18

| | No. 92 |
|---|---|
| Shrinkage Percentage after Washing (%) | 1.5 |
| Handling (Flexibility) | ○ |
| Handling (Stiffness) | ○ |
| Degree of Fibrilation | ○ |

As shown clearly in Tables 17 and 18, even if fine granular regenerated chitosan of another additive is used in manufacturing improved regenerated cellulose fiber according to the present invention, an improvement in degree of swelling is also observed without impairing strength and elongation. In addition, the knitted fabric of the Sample No. 92 made using this yarn provides a dramatic improvement in shrinkage percentage after washing and a stiff handling without losing a flexibility. The knitted fabric of the Sample No. 92 also exhibits sufficient antibacterial activity in an evaluation in accordance with JIS L 1902 (1998).

What is claimed is:

1. An improved regenerated antibacterial cellulose fiber obtained by the process comprising:

adding and mixing a crosslinking agent having two or more reactive functional groups in a molecule and fine granular chitosan to a cellulose viscose solution;

spinning the viscose solution by extruding into a coagulation and regeneration bath; and applying a heat treatment, wherein the cellulose fiber includes an inner part containing cellulose molecules crosslinked therebetween by the crosslinking agent and fine granular chitosan.

2. An improved regenerated antibacterial cellulose fiber obtained by the method comprising:

adding and mixing a crosslinking agent having two or more reactive functional groups in a molecule and fine granular chitosan to a cellulose viscose solution;

spinning the viscose solution by extruding into a coagulation and regeneration bath; and applying a heat treatment, wherein the cellulose fiber includes within an inner part containing cellulose molecules crosslinked therebetween by the crosslinking agent and an outer part of a cellulose fiber is crosslinked by the crosslinking agent.

3. An improved regenerated cellulose fiber according to claim 1, wherein said crosslinking agent is an epoxy-based crosslinking agent having glycidyl ether group or chlorohydrin group as the reactive functional group.

4. An improved regenerated cellulose fiber according to claim 1, wherein fine particles of mixed-in additives are further mixed within inner part of the cellulose fiber.

5. An improved regenerated cellulose fiber according to claim 2, wherein said crosslinking agent is an epoxy-based crosslinking agent having a glycidyl ether group or chlorohydrin group as the reactive functional group.

6. An improved regenerated cellulose fiber according to claim 2, wherein fine particles of mixed-in additives are further mixed within the inner part of the cellulose fiber.

7. An improved regenerated cellulose fiber according to claim 3, wherein fine particles of mixed-in additives are further mixed within the inner part of the cellulose fiber.

8. An improved regenerated cellulose fiber according to claim 5, wherein fine particles of mixed in additives are further mixed throughout the inner part of the cellulose fiber.

* * * * *